US005292335A

United States Patent [19]

Shin

[11] Patent Number: 5,292,335

[45] Date of Patent: Mar. 8, 1994

[54] INFANT PACIFIERS WITH DIAPHRAGM MELODY GENERATOR

[76] Inventor: Jong-Hyun Shin, 212 Kumho Apt. Chunho 1-Dong, Kangdong-Gu, Seoul, Rep. of Korea

[21] Appl. No.: 955,652

[22] Filed: Oct. 2, 1992

[30] Foreign Application Priority Data

Oct. 10, 1991 [KR] Rep. of Korea ..... 91-16678

[51] Int. Cl.[5] ..... A61J 17/00

[52] U.S. Cl. ..... 606/234; D24/196

[58] Field of Search ..... 606/234–236; 215/11.1–11.6; D24/194–199

[56] References Cited

U.S. PATENT DOCUMENTS

| | | | |
|---|---|---|---|
| 4,586,621 | 5/1986 | Dahan | 215/11.1 |
| 4,726,376 | 2/1988 | Dahan | 215/11.1 |
| 4,768,510 | 9/1988 | Leung | 606/234 |
| 4,856,519 | 8/1989 | Teves | 606/234 |

*Primary Examiner*—Stephen C. Pellegrino
*Assistant Examiner*—Glenn Dawson
*Attorney, Agent, or Firm*—Lieberman & Nowak

[57] ABSTRACT

An infant pacifier with a diaphragm melody generator in which only when the infant holds the pacifier in the mouth and sucks or mumbles, a diaphragm switch of the melody generator is operated in order to permit the generator to generate melody. The present pacifier comprises a nipple part for being held by the infant mouth, a handle part for permitting the pacifier to be handled and a melody generator. The melody generator comprises a diaphragm switch for turning on/off the melody generator in accordance with the holding force and an electronic circuit board for generating the melody in cooperation with the diaphragm switch when the infant holds the nipple part of the pacifier in the mouth. The diaphragm switch is applied with conductive ink at its center and easily expanded and contracted by the holding force. The electronic circuit board has a switching portion, at which positive and negative terminal wires are provided such that they are normally spaced apart from each other, at its center and is disposed such that it is minutely spaced apart from the diaphragm switch.

5 Claims, 2 Drawing Sheets

INFANT PACIFIERS WITH DIAPHRAGM MELODY GENERATOR

BACKGROUND OF THE INVENTION

1. Field of the Invention

The present invention relates in general to pacifiers for infants, and more particularly to infant pacifiers with a diaphragm melody generator in which only when the infant holds the pacifier in the mouth and sucks or mumbles, a diaphragm switch of the melody generator is operated in order to permit the generator to generate melody.

2. Description of the Prior Art

Conventionally, infants have an instinctive urge of holding something in the mouth even when they do not suck milk and, in order to satisfy such a infant instinctive urge, various types of infant pacifiers have been proposed.

With reference to FIG. 1 showing a representative embodiment of a known infant pacifier, this type of pacifier 1 generally comprises a soft nipple part 2, preferably made of rubber, and a handle part 3 provided with a handle loop.

However, this embodiment has a problem in that it has only a simple function for somewhat satisfying the infant urge for holding something in the mouth and, in this respect, the infants are easily tired of it.

In order to solve such a problem caused by the above known embodiment, there has been proposed another type of infant pacifier which is provided with a melody generator generally equipped in the handle part of the pacifier. It is noted that this type of pacifier has an advantage in that it satisfies the infant urge of holding something in the mouth and generates a melody which causes the infant to take an interest in it and have a tender feeling for it.

However, since this type of pacifier, having the melody generator, can not be operated by the user, that is, the infant, but necessarily manually operated by those close to the infant in order to generate the melody, it has a disadvantage of occurrence of inconvenience in using. Furthermore, as this type of infant pacifier continuously generates the melody for a predetermined time regardless of intention of the infant, it may have a bad influence upon the character formation of the infant.

SUMMARY OF THE INVENTION

It is, therefore, an object of the present invention to provide an infant pacifier with a diaphragm melody generator in which the above disadvantages can be overcome and its diaphragm switch is operated in order to generate melody only when the infant holds the nipple part of pacifier in the mouth and sucks or mumbles the nipple part.

In order to accomplish the above and other objects, the present invention provides an infant pacifier comprising: a nipple part for being held by the infant mouth; a handle part for permitting the pacifier to be handled; and melody generating means for generating melody, said means being enclosed in said handle part and operated by holding force generated when the infant holds the nipple part.

In a preferred embodiment, the melody generating means comprises a diaphragm switch for turning on/off the melody generating means in accordance with the holding force, said diaphragm switch being applied with conductive ink at its center and easily expanded and contracted by the holding force; and an electronic circuit board for generating the melody in cooperation with the diaphragm switch when the infant holds the nipple part of the pacifier in the mouth, said electronic circuit board having a switching portion, at which positive and negative terminal wires are provided such that they are normally spaced apart from each other, at its center and being disposed such that it is minutely spaced apart from the diaphragm switch.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
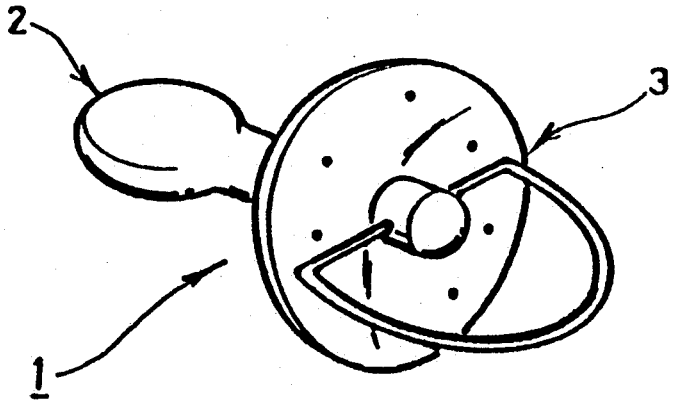
FIG. 1 is a perspective view of an embodiment of a known infant pacifier.
Figure 2:
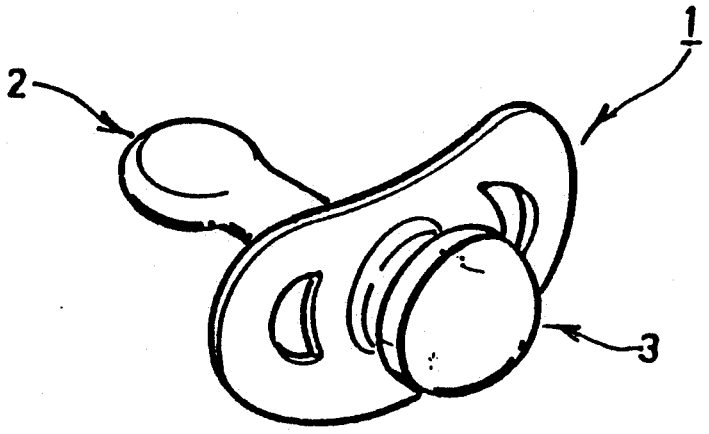
Prior Art FIG. 2
FIG. 2 is a view corresponding to FIG. 1, but showing the present invention.

With reference to FIG. 2, there is shown a perspective view of an embodiment of an infant pacifier in accordance with the present invention. The infant pacifier 1 generally includes, in similar to the prior melody generating pacifier, a suction nipple part 2, which is to be held by the infant mouth, and a handle part 3 in which a melody generator B is equipped.

Here, the present melody generating pacifier 1 has an inventive characteristic in that it is designed to cause the melody generator B to be turned on/off by pressure transfer of the inner pressure of the pacifier 1. Such a pressure transfer is caused by whether the infant holds or releases the nipple part.

Figure 3:
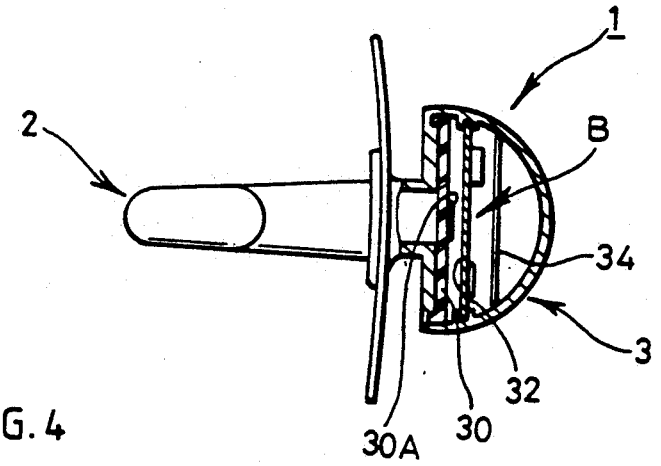
FIG. 3 is a partially sectioned view of the embodiment of FIG. 2.
Figure 4:
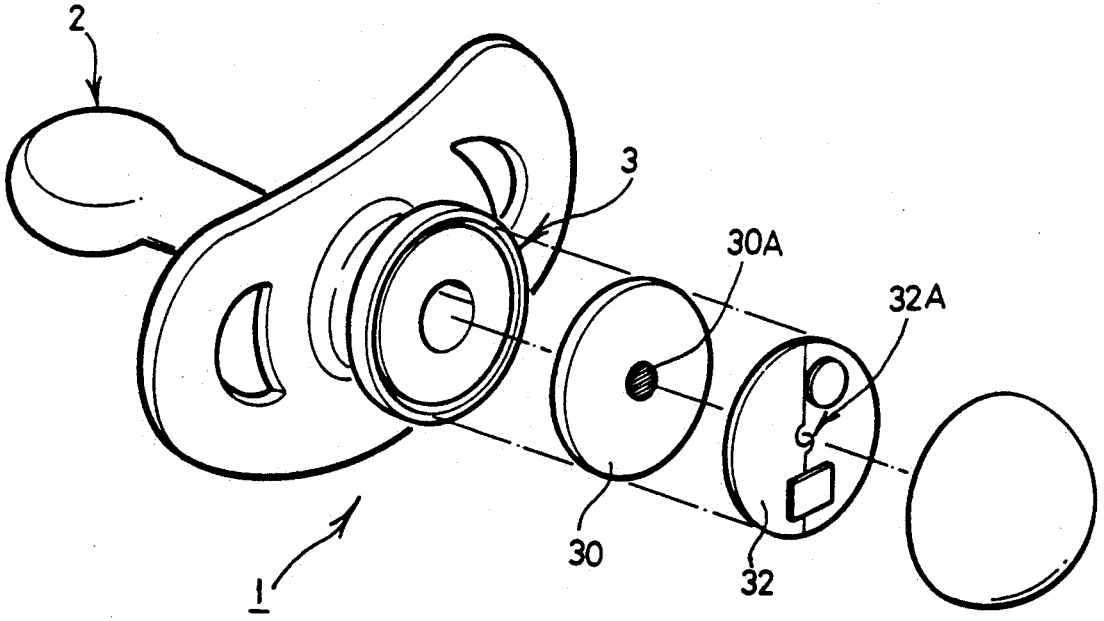
FIG. 4 is an exploded perspective view of the embodiment of FIG. 2.

In other words, the melody generator B enclosed in the handle part 3 of the pacifier 1 comprises, as depicted in FIGS. 3 and 4, a diaphragm switch 30 which is applied with conductive ink 30A at its center and preferably made of soft synthetic resin or rubber in order to be easily expanded and contracted even by a relative lower pressure. In addition, in order to generate the melody in cooperation with the diaphragm switch 30 when the infant holds the nipple part 2 of the pacifier 1 in the mouth and sucks or mumbles the part, an electronic circuit board 32, having a switching portion 32A at its center, is provided such that it is minutely spaced apart from the diaphragm switch 30. At the switching portion 32A, the electronic circuit 32 is provided with the positive and negative terminal wires which are normally spaced apart from each other as shown in FIG. 4.

As depicted in FIG. 3, a speaker 34 is disposed at a position which is opposite to the diaphragm switch 30 with respect to the electronic circuit board 32 and spaced apart from the board 32 by a predetermined interval. Here, the diaphragm switch 30, the electronic circuit board 32 and the speaker 34 are preferably incorporated with the handle part 3 of the pacifier 1 by fitting or bonding.

The operational effect of the present infant pacifier 1 having the aforementioned construction will be described as follows.

When the infant holds the nipple part 2 of the pacifier 1 in the mouth and sucks or mumbles it, the nipple part 2 is compressed and there occurs pressure transfer of inner pressure of the pacifier 1 from the nipple part 2 to the diaphragm switch 30 inside the handle part 3. As a result, the diaphragm switch 30 is caused to expand toward the electronic circuit board 32 until its center part, which is applied with the conductive ink 30A, comes into close contact with the switching portion 32A of the electronic circuit board 32. In accordance, the positive and negative terminal wires of the switching portion 32A are connected to each other through the conductive ink 30A of the diaphragm switch 30 and this permits the electronic circuit board 32 to be turned on. In this respect, the melody generator B starts its operation in order to generate the melody by way of the speaker 34.

On the other hand, when the infant stops sucking or mumbling the nipple part 2 of the pacifier 1, the inner pressure of the pacifier 1 returns to its original state, that is, a state of equilibrium. In other words, the compressed inner pressure biasing the diaphragm switch 30 toward the electronic circuit board 32 is expelled to the inside of the released nipple part 2. In this regard, the diaphragm switch 30 returns to its original state wherein it is minutely spaced apart from the electronic circuit board 32 and, in this state, the melody generator B is turned off in order to stop generating the melody.

As described above, the present invention provides an infant pacifier having a melody generator which is simply operated, without additional manual operation, owing to pressure transfer of the inner pressure of the pacifier which occurs only when the infant holds the soft nipple part of the pacifier in the mouth and sucks or mumbles the nipple part, thereby simplifying its operation. In addition, the melody generator is not operated by those close to the infant but freely operated in response to the infant intention and this causes the infant to efficiently develop its intellectual powers, furthermore, this efficiently entertains the infants. Differently from the prior embodiment, the present infant pacifier is prevented from continuous generation of the melody against intention of infants and, in this respect, has no bad influence upon the character formation of infants.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. An infant pacifier comprising:

a nipple for insertion into an infant's mouth;

a handle coupled to the nipple for permitting the pacifier to be held; and melody generating means enclosed within the handle and being activatable by a pressure transfer generated when the infant compresses the nipple, the melody generating means including a diaphragm switch for turning on or off the melody generating means in response to the pressure transfer, the diaphragm switch having a conductive material at its center and being deformable by the pressure transfer, and an electronic circuit board for generating a melody in response to activation of the diaphragm switch, the electronic circuit board having a switching portion with separated positive and negative terminal wires, the positive and negative terminal wires being minutely spaced apart from the diaphragm switch so that deformation of the diaphragm switch allows the conductive material at the center of the diaphragm switch to form a circuit between the positive and negative terminal wires.

2. An infant pacifier of claim 1, wherein the nipple comprises a soft material selected from the group consisting of rubber or resin.

3. An infant pacifier of claim 1, wherein the handle comprises a plastic.

4. An infant pacifier of claim 1, wherein the conductive material at the center of the diaphragm switch comprises a conductive ink.

5. An infant pacifier of claim 1, wherein the melody generating means comprises a speaker.

* * * * *